US005144369A

United States Patent [19]

Benedict et al.

[11] Patent Number: 5,144,369

[45] Date of Patent: Sep. 1, 1992

[54] DEVELOPER UNIT ALIGNMENT, REMOVAL AND INTERCHANGE SYSTEM

[75] Inventors: Lawrence R. Benedict, Rushville; A. Lance Marchese, Honeoye Falls, both of N.Y.

[73] Assignee: Xerox Corporation, Stamford, Conn.

[21] Appl. No.: 757,150

[22] Filed: Sep. 10, 1991

[51] Int. Cl.[5] ..... G03G 15/00

[52] U.S. Cl. ..... 355/245; 355/326; 414/401

[58] Field of Search ..... 355/200, 245, 326; 414/389, 396, 401, 402

[56] References Cited

U.S. PATENT DOCUMENTS

| | | | |
|---|---|---|---|
| 4,097,139 | 6/1978 | Hauser et al. | 355/4 |
| 4,671,728 | 6/1987 | Clark et al. | 414/401 |
| 4,894,684 | 1/1990 | Nakajima et al. | 355/245 X |
| 5,053,820 | 10/1991 | Preszler et al. | 355/245 |

*Primary Examiner*—Joan H. Pendegrass

[57] ABSTRACT

An improved system for exchanging a developer unit of a copying or printing machine by moving the developer unit between a portable developer unit transporter cart or the like and the development station of the machine while the cart is docked in alignment therewith, the cart has a liftable development unit holder and a simple but effective foot pedal operated lifting system for automatically lifting it up to the same level as the development station in said machine, so that developer unit rails thereon are in accurate alignment with rails in the development station for easily moving a developer unit therebetween, irrespective of variations in the level of the cart and the machine due to floor or machine alignment differences. Also disclosed is a system of assisting the lateral alignment of the cart with the machine for docking, and safety interlock systems.

9 Claims, 8 Drawing Sheets

DEVELOPER UNIT ALIGNMENT, REMOVAL AND INTERCHANGE SYSTEM

Disclosed is an improved system for the removal and interchanging of a developer unit of a copying or printing machine.

The provision of interchangeable developer units or housings utilizing a wheeled cart transport and a type of cart/machine alignment system, for allowing the developer housings to be removed and/or interchanged, is disclosed in Xerox Corporation U.S. Pat. No. 4,097,139 issued Jun. 27, 1978 to O. G. Hauser, et al..

The present system is an improvement thereon, providing improved operator convenience and improved and simplified alignment of the developer unit transport cart or carrier with the developer unit or module to be removed and/or interchanged. In particular, the present system readily accommodates variations in the height or level (alignment) of the copier or printer and/or the floor.

The present system is capable of aligning a developer unit in a transport cart with the developer unit in the copier or printer irrespective of floor conditions or machine height or level variations which would otherwise change the height or level of a developer unit mounting in the machine relative to the height or level of the cart or other loading or removal transport therefor.

The present system is particularly suitable for providing simple, low force, and rapid interchange of developer units providing different colors of development material, allowing convenient changing of different colors to be printed in a copier or printer. One example of such a machine with which the present system may be utilized is described in Xerox Corporation U.S. Pat. Nos. 4,811,046 or 4,847,655.

The present system is particularly suitable for a copier or printer in which only one or two developing units need be provided at any one time in the machine. By interchanging at least one of these developer units for another from outside the machine, utilizing the present system, a variety of different interchangeable "highlight" colors, or the exchange of black printing for a color, may be readily provided.

Furthermore, plural, interchangeable, transport units may be provided for transport and storage of plural developer units between the machine and the storage area and back, or between different machines, providing they are adapted for alignment therewith.

As disclosed in the specific embodiment example hereinbelow, this alignment may be accomplished substantially automatically by simple, non-critical, operator operation of a foot pedal or other lever on the developer unit transport unit or cart actuating a low cost and simple system for variably converting that simple movement into an accurate automatic alignment whereby the cart mounting for a developer unit is accurately aligned with, and at the same level as, the machine mounting for a developer unit, so that a developer unit may be readily moved from one to the other.

Additionally disclosed herein is a safety interlock system preventing the developer unit transport cart from being undocked from the machine when a developer unit is being moved therebetween, and a safety interlock system preventing the developer unit transport cart from lowering the developer unit while a developer unit is being moved therebetween.

Further by way of background, in electrostatographic reproducing machines, and more particularly in well known commercial xerographic machines with two-component development (mixed carrier material and toner material), the developer unit or carriage tends to be quite heavy, due to the weight of the magnetic carrier material, toner, developer rollers and drive components and developer roller magnets, augers, housings, etc.. Yet such two-component development is particularly desirable for developing electrostatic latent images with colored toner. Typically the entire developer unit is a module which slide-mounts in and out of its operating position under the photoreceptor in the copier or printer machines on horizontal slide rails of some sort. To lift or carry a removed developer unit, or load a new developer unit into the machine, is difficult, especially, to hold the unit so as to not spill or stain the operator with toner material therefrom, yet accurately align the new (replacement) unit with the horizontal mounting slide rails of the machine before it is slid into the machine. Nor is it normally practical, clean, or timely to purge a developer unit of one materials package and substitute another. Thus, rapid substitution of a another, pre-loaded, entire developer unit is preferred.

As to specific hardware components of the subject apparatus, it will be appreciated that, as is normally the case, some such specific hardware components are known per se in other apparatus or applications, and these need not be described in detail herein.

A specific feature of the specific embodiment(s) disclosed herein is to provide, in a system for exchanging a developer unit of a copying or printing machine, in which the developer unit is moved between a movable developer unit transporter and a development station in said machine while said movable developer unit transporter is docked in alignment with said machine, the improvement wherein: said movable developer unit transporter has liftable development unit holding means adopted to hold and lift a said developer unit thereon; and said movable developer unit transporter includes means for automatically lifting said development unit holding means up to the same level as said development station in said machine, so that a said developer unit thereon is in alignment with said development station in said machine for exchanging a said developer unit, irrespective of variations in the level of said developer unit transporter and said machine.

Further specific features provided by the system disclosed herein, individually or in combination, include those wherein said liftable development unit holding means includes developer unit movement rails adapted to fully align with developer unit movement rails in said development station in said machine for direct movement of a said developer unit therebetween when said means for automatically lifting said development unit holding means up to the same level as said development station in said machine is actuated; and/or wherein said means for automatically lifting said development unit holding means up to the same level as said development station in said machine includes docking hook means on said liftable development unit holding means, and a docking bar on said machine which is normally at a higher level than said docking hook means so that said docking hook means is movable thereunder with movement of said developer unit transporter, and pedal actuated means for first lifting said hook means into engagement with said docking bar and then pivoting said hook means about said docking bar to lift said development unit holding means into alignment with said development station in said machine; and/or further including automatic latching means for latching said development unit holding means in said aligned position with said development station of said machine until said latching means is released, and/or further including safety interlock means for preventing lowering of said development unit holding means or undocking of said developer unit transporter from said machine when a developer unit is in transition between said developer unit transporter and said machine; and/or further including means for assisting the lateral alignment of said developer unit transporter with said machine for said docking comprising lateral alignment guide members projecting from the lower front of said developer unit transporter and fixed vertical lateral alignment guide surfaces on the lower front of said machine adapted to engage said lateral alignment guide members on said developer unit transporter to laterally guide its final lateral docking movement; and/or a visual docking guide on the upper front of said developer unit transporter and a visual docking guide target on the front of said machine above said lateral alignment guide surfaces positioned so that when said developer unit transporter is moved so that said visual docking guide is adjacent said visual docking guide target that said lateral alignment guide members engage said lateral alignment guide surfaces; and/or wherein said means for automatically lifting said development unit holding means up to the same level as said development station in said machine comprises operator actuated lever means moveable in a single constant distance movement to automatically lift said development unit holding means up to the same level as said development station irrespective of said variations in the level of said developer unit transporter and said machine.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

Figure 1:
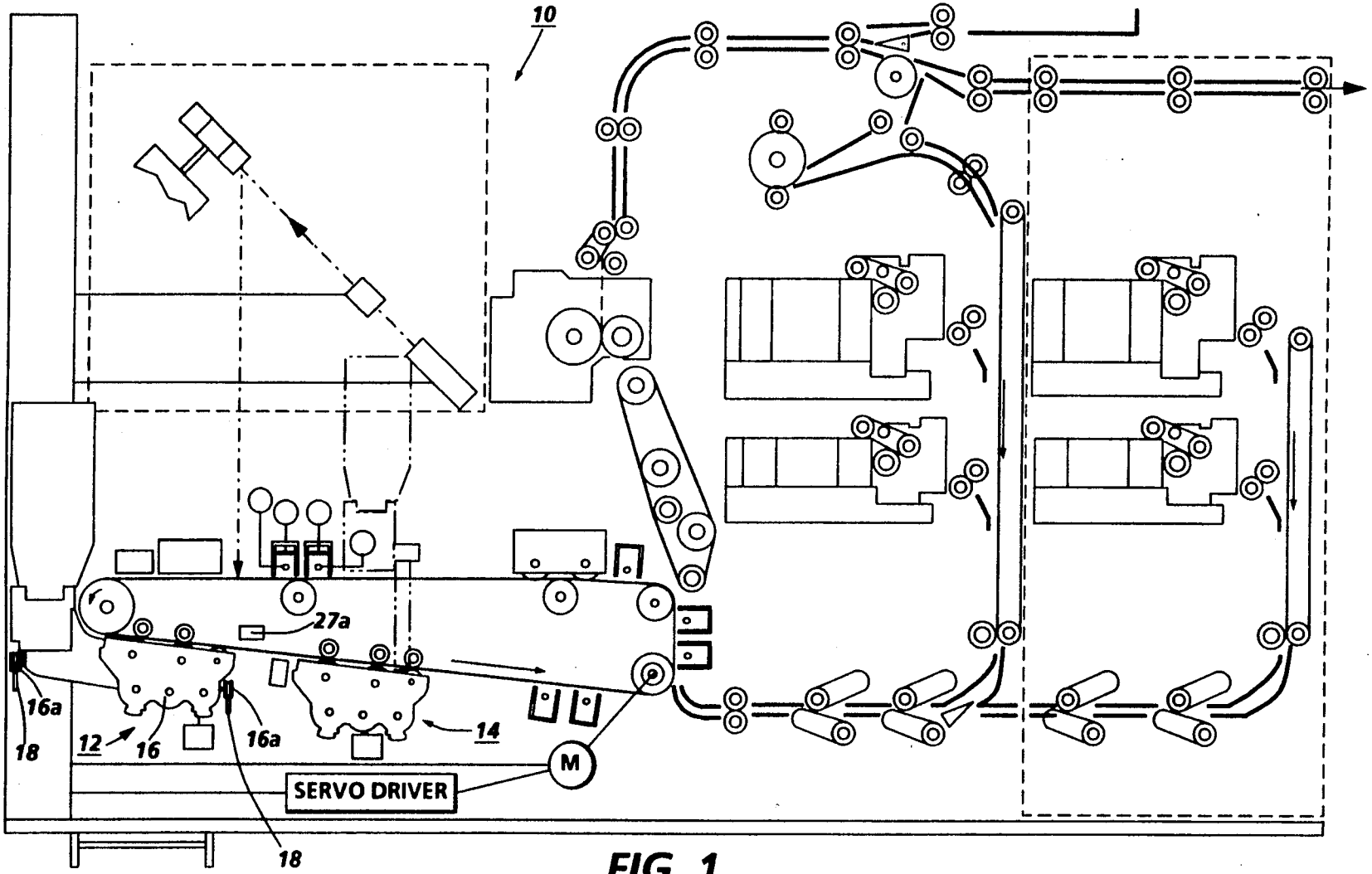
FIG. 1 is a schematic frontal view of one embodiment of an exemplary printing machine utilizing the present system.
Figure 2:
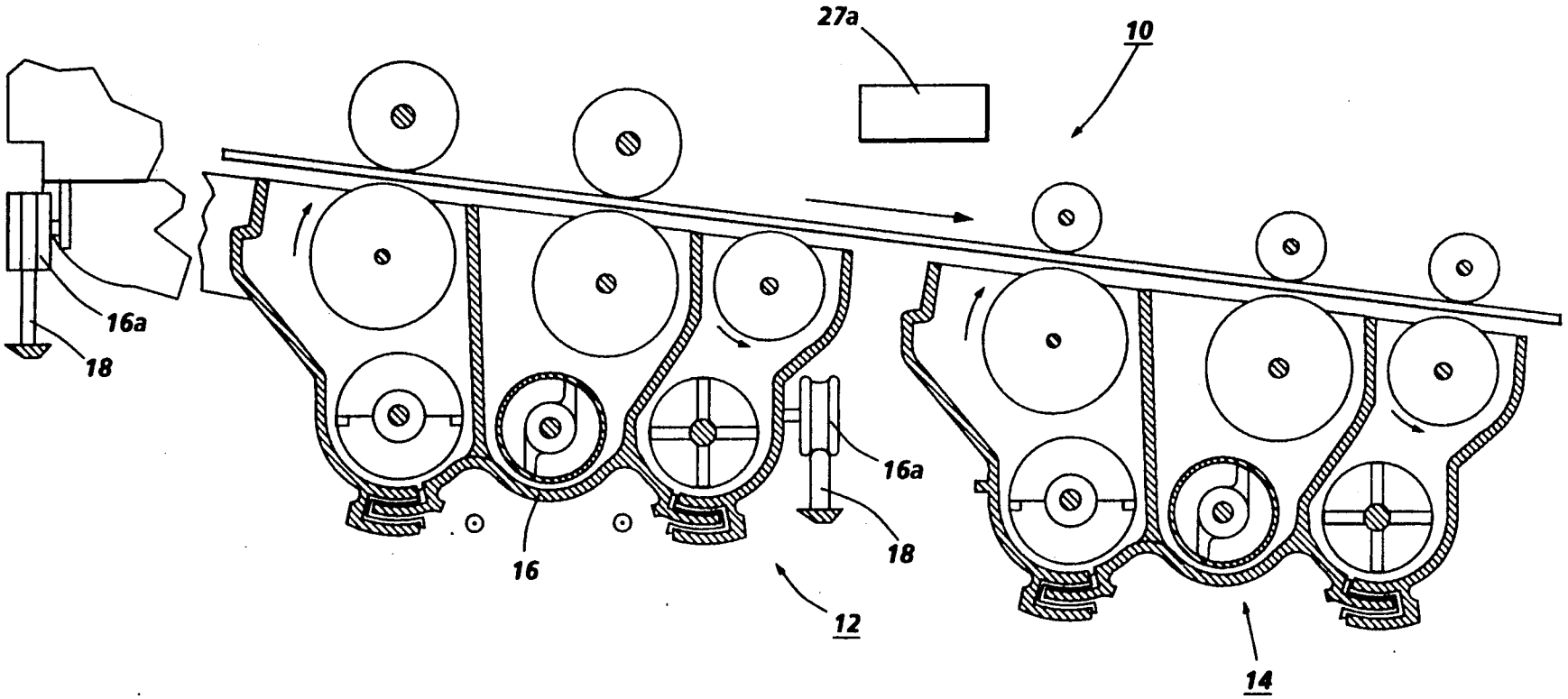
FIG. 2 is an enlarged partial view in cross section of the developer units area of the exemplary printing machine of FIG. 1.
Figure 10:
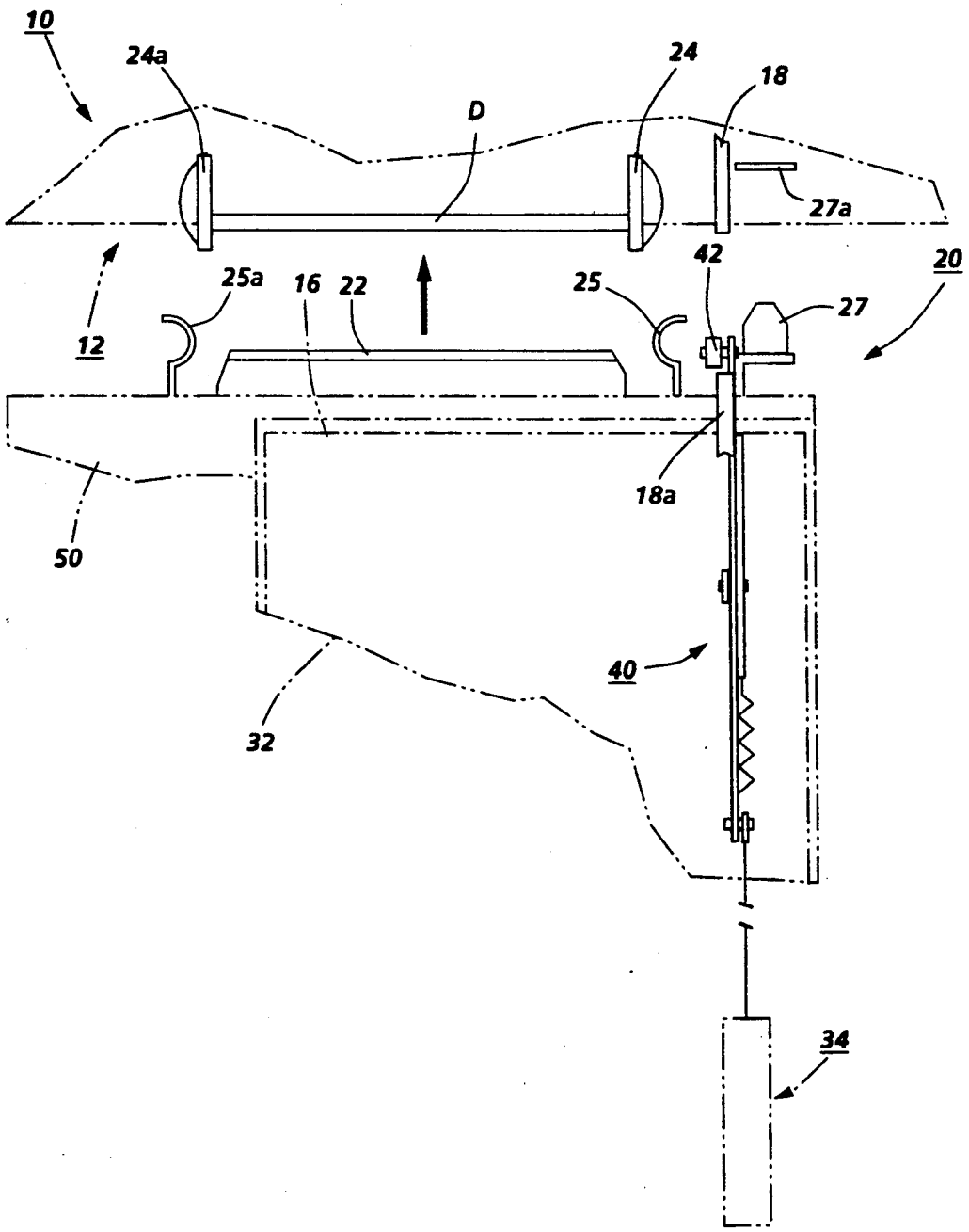

and FIG. 10 is a partial top view of the front portion of the developer transport cart of FIGS. 3–9, and the associated docking elements of the exemplary printing machine of FIGS. 1 and 2, as they approach docking.

Describing now in further detail this exemplary embodiment with reference to the Figures, there is shown in FIG. 1, by was of one example of a copier or printer, an electronic highlight or two color printer reproducing machine 10 as shown in the above-cited U.S. Pat. Nos. 4,811,046 or 4,847,655. This machine 10 has two development stations 12 and 14, with respective developer units. At least one of these developer units, here 16, is desirably rapidly interchangeable with another developer unit loaded with a different developer materials package in order to rapidly change printing colors. To that end, at least the developer unit 16 is conventionally mounted on fixed parallel pairs of horizontal rails 18 in the machine 10. Here, the developer unit 16 may be rolled in or out of the machine 10 on its wheels **16*a* rolling on the rails 18**.

As will be further described, the machine 10, and connectable movable developer unit transport carts 20, are adapted for a cart 20 to dock and align with at least one of the machine 10 development stations, here development station 12, so that its developer unit 16 can be rolled or slid out on its rails 18 or the like onto mated and horizontally mutually aligned rails or supports **18*a* on the cart 20, irrespective of floor conditions or machine height or level variations which would otherwise change or render uneven or unmatched the height or level of the developer unit 16 in the machine 10 relative to the height or level of the cart 20. Then the cart 20 can be removed (wheeled away from the machine) carrying the removed developer unit. Alternatively, a cart 20 already carrying a replacement developer unit thereon can accurately raise that developer unit up to the level of the machine 10 development station 12 so that this replacement developer unit can be directly horizontally slid from the cart 20 rails 18*a* onto the developer unit mounting rails 18 of the machine 10**.

Also described further below is a safety interlock system 40 preventing the developer unit transport cart 20 from being undocked from the machine 10 when a developer unit is being moved therebetween. Also, a safety interlock system preventing the developer unit transport cart 20 from lowering the developer unit 16 while the deveîoper unit 16 is being moved therebetween in or out of the machine 10.

Figure 3:
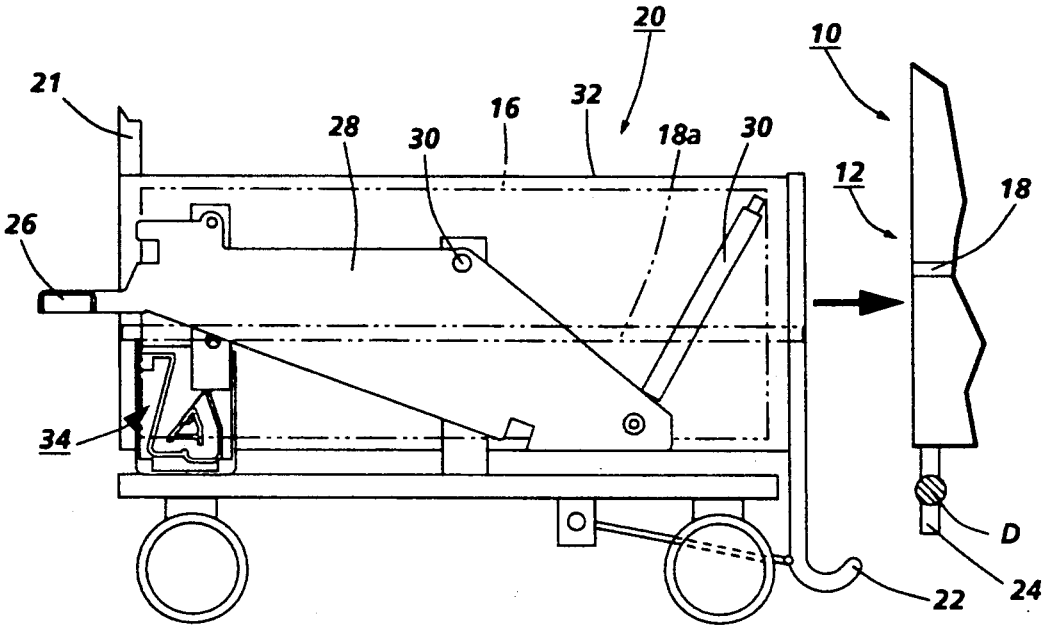
FIGS. 3–7 are schematic side views, in different sequential operating positions, of an exemplary developer transport unit (cart) as it is docked and aligned with the exemplary printing machine of FIGS. 1 and 2.
Figure 4:
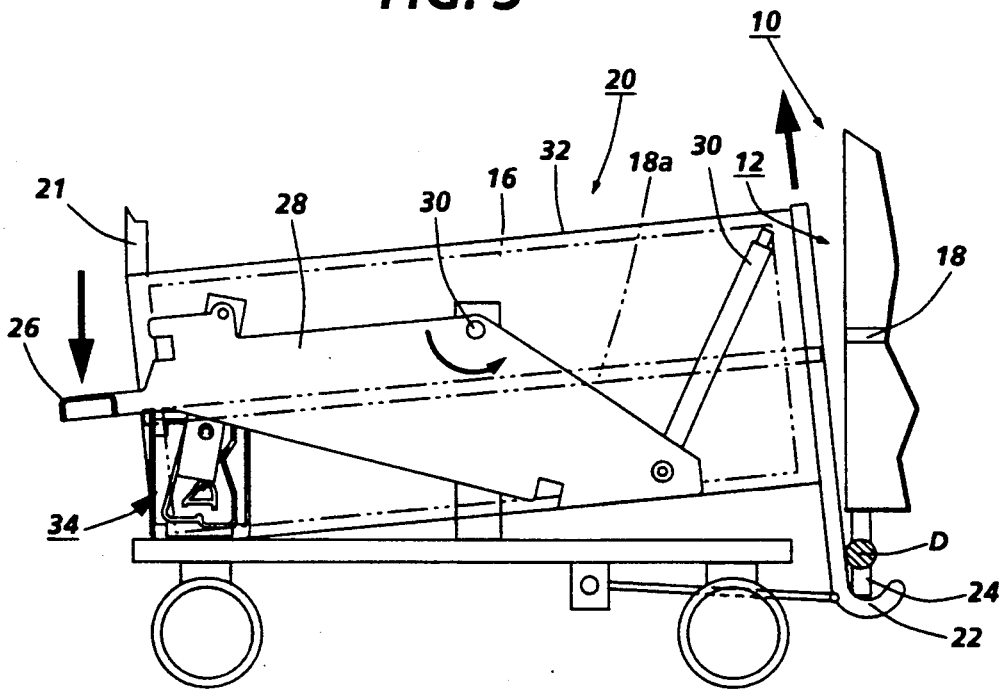
Figure 5:
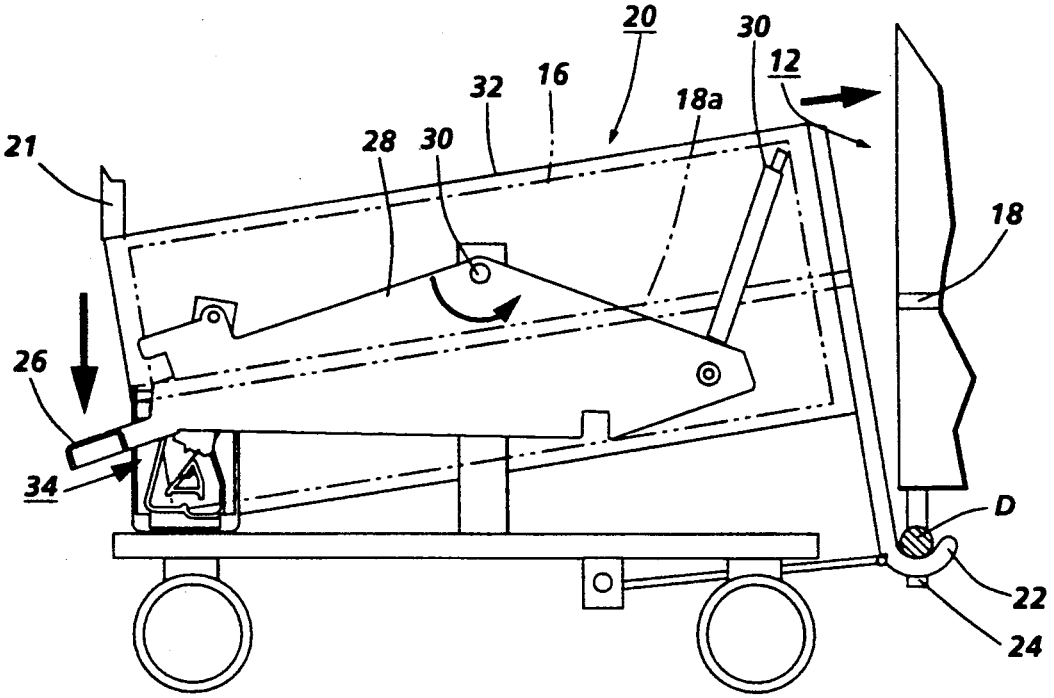
Figure 6:
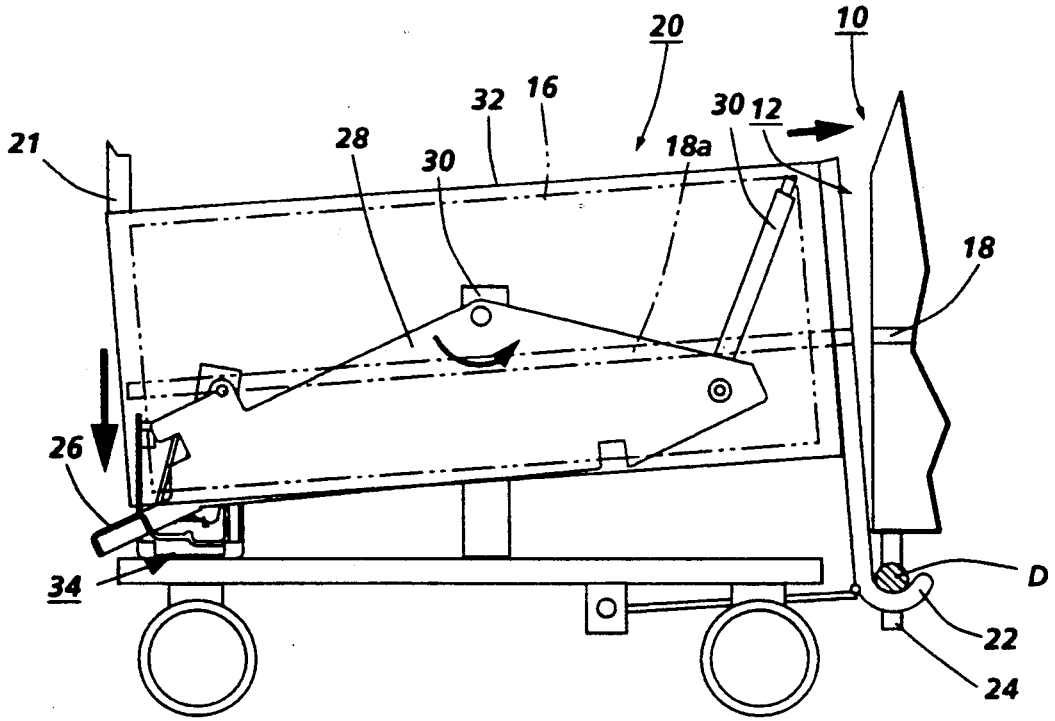

Describing now the basic operation for docking the cart 20 with the machine 10, for loading or unloading a developer unit into or from the machine 10 (unloading is simply the reverse), this will be with particular reference to the sequence of schematic, simplified, FIGS. 3 through 7. First, FIG. 3 shows the exemplary four-wheeled cart 20 being pushed towards the machine 10 developer unit area 12 (after the machine 10 front cover is opened to expose it). The cart 20 is pushed by the operator by a convenient high-rise cart handle bar 21 towards the machine until the lower front of the cart abuts a docking bar surface D on the lower front of the machine 10 frame. A frontally projecting hook, shelf or foot 22 on the cart 20 passes slightly under docking bar D at that point, as shown in FIGS. 4–5.

As better shown in FIG. 10, lateral alignment guides (here vertical bars) 24, **24*a* on the machine 10 locate the cart 20 laterally as it moves in towards the machine 10 during initial alignment, by engaging lateral alignment spring tabs 25, 25*a* on the front of the cart 20 at opposite sides of the hook 22. Other suitable lateral alignment means may be alternatively used, such as alignment apertures. An optional bright colored visual inital alignment aide 27** may be provided higher up on the front of cart 20 to be aligned by the operator with a similarly colored target patch 27*a* on the machine 10, so that the operator does not have to actually see the alignment of the tabs 25, 25*a* in the apertures 24, 24*a*. Note that no vertical alignment, and only a rough lateral (side to side) alignment, is done manually by the operator. The final lateral alignment is made in the final part of the movement of the cart against the machine 10, by the tabs 25, 25*a* laterally aligning the cart as the tabs 25, 25*a* engage the lateral alignment guides 24, 24*a* on the machine 10. Laterally sloped or angled surfaces (such as the illustrated "?" shape) of the tabs 25, 25*a* here, guide the cart into this final lateral alignment achieved with cart 20 abutment against the machine 10.

Figure 7:
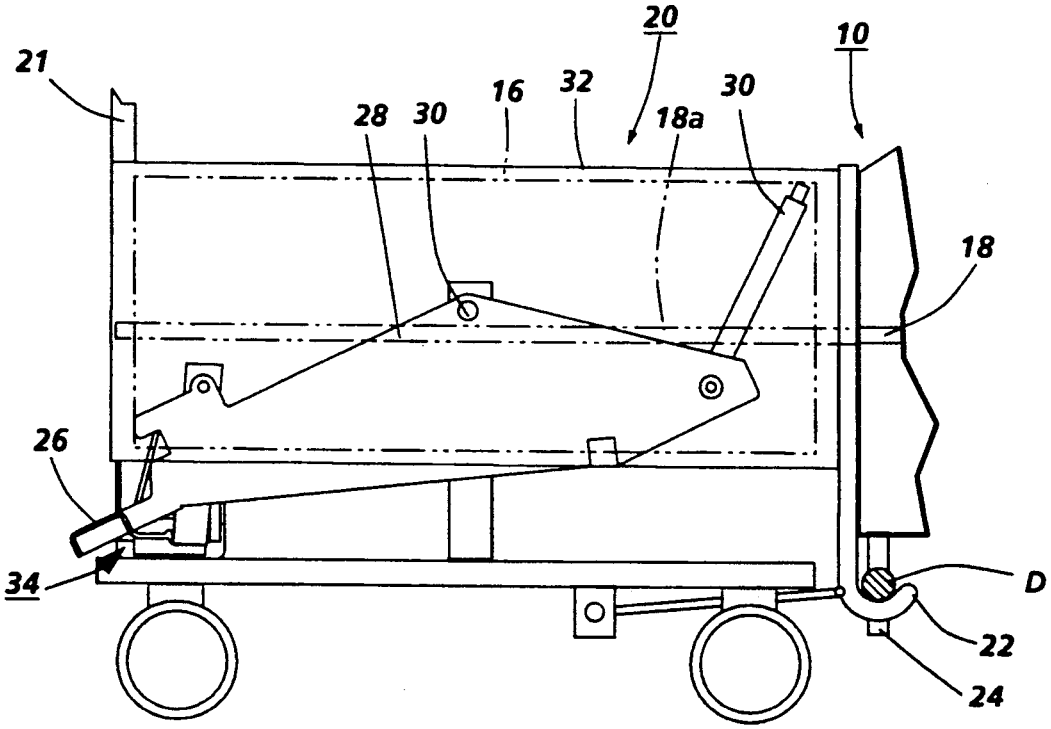

As shown in FIG. 4, after the cart 20 is so initially docked against the machine 10 docking bar D, with hook 22 on the cart 20 under docking bar D, then the operator steps on the foot pedal 26 at the rear of the cart 20. Depression of pedal 26 pivots a connected main pedal link or arm 28 around its central pivot 30. The inner end of this pivoted link 28, on the opposite side of pivot 30 from pedal 26, is fastened to and pushes up on the piston end of gas spring 30. The opposite or cylinder end of this gas spring 30 is fastened to and lifts up the inner (machine) end of a movable developer rail assembly or unit 32, which was initially resting in the frame of the cart 20. That is, the cart 20 has two main components, a main frame including the wheels and the pivot 30 axis, and the developer rail unit 32 which is movable relative to the main frame, and which carries the developer unit on rails 18*a*. The hook 22 is fastened to and part of this developer rail unit 32. The front of this developer rail unit 32 lifts up in this manner with the downward pedal 26 movement until the hooked lower end 22 thereof engages the machine 10 docking pivot bar D, as shown in FIG. 5. At that point, the hook 22 engagement with machine pivot bar D prevents further lifting up of the front of the developer rail unit 32, and the rest of the developer rail unit 32 must start to pivot up about pivot bar D. This pivoting up of the unit 32, continues through the FIG. 6 position, until, as in FIG. 7, a front engagement area of the movable developer rail assembly 32 abuts and is flush with the (vertical) front of the machine 10 in that area, automatically resulting in common vertical and horizontal alignment of the developer rail unit 32 with the machine 10. After that, further continuing depression of pedal 26 forces the gas spring 30, (which has been uncompressed until this point), to now begin to compress with further pedal 26 depression. That is, this gas spring 30 compression or piston-stroke absorbs further pedal depression until the downwardly moving pedal 26 reaches a lower stop position (preferably lower than as shown in FIG. 7), at which time the system also reaches or activates a pedal cam lock 34 (described below), which locks the pedal in a down position, thus locking the developer rail unit 32 in this up (aligned) position of FIG. 7.

Note that a single simple and uncritical downward pedal movement (operator pedal step-on) accomplishes all of these above-described vertical movements. At this point, as in FIG. 7, the cart 20 is automatically in alignment with the machine 10, so that rails pairs 18 and 18*a* are aligned and have their respective rail ends substantially abutting, so that a developer unit 16 on the cart can be horizontally rolled on its wheels 16*a* or the like off of the cart 20 on the rails 18*a* onto the mated and horizontally mutually aligned rails 18 in the machine 10, irrespective of floor conditions or machine height or level variations. A developer unit may be rolled into the machine 10 from rails 18*a* onto rails 18, for loading. Or, a developer unit 16 in the machine can be rolled out of the machine on rails 18 and onto rails 18*a* of an empty cart 20 for unloading. Then, in the case of unloading, the cart 20 is rolled away from the machine and another cart 20 carrying another (replacement or interchange) developer unit is moved into place and aligned or docked in the same manner, for replacing the original developer unit with another developer unit. This replacement developer unit will usually, but not necessarily, be a unit loaded with a different color toner material, but otherwise preferably identical or interchangeable.

A safety interlock system 40 prevents the developer unit transport cart 20 from being undocked from the machine 10 when a developer unit is being moved therebetween. This, or another, safety interlock system also prevents the cart 20 from lowering the developer unit 16 while the developer unit 16 is being moved therebetween in or out of the machine 10. This safety interlock system 40 may be, for example, a cam 42 depressed by the wheels 16*a* or other component of the developer unit when the developer unit is anywhere in said transition between the cart 20 and the machine 10, which cam 42 may connect by flexible cable to the pedal cam lock 34 to prevent the pedal 26 and thus the pedal link or arm 28 from releasing from its fully depressed down position. Once the developer unit is fully loaded or unloaded, the pedal cam lock 34 may be released, to lower the developer rail unit 32 and any developer unit thereon, simply by stepping on the pedal 26 again. This also allows the cart to be unlocked from its docked position, by also lowering the hook 22 on the cart 20 below docking bar D, so the cart can release from the docking bar D and be pulled away (undocked).

Figure 8:
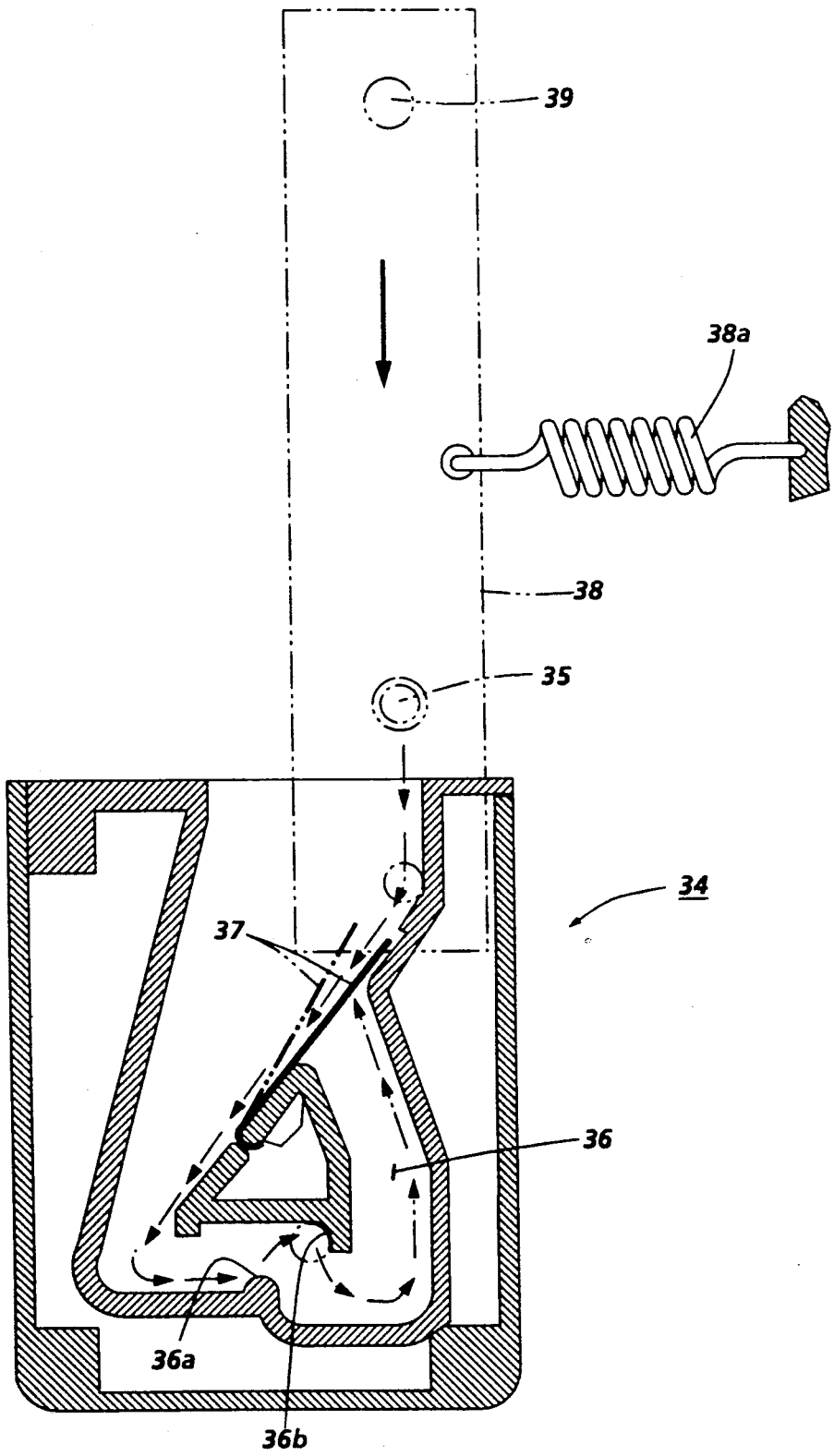
FIG. 8 is an enlarged view of an exemplary pedal locking system of the exemplary developer transport cart of FIGS. 3–7.
Figure 9:
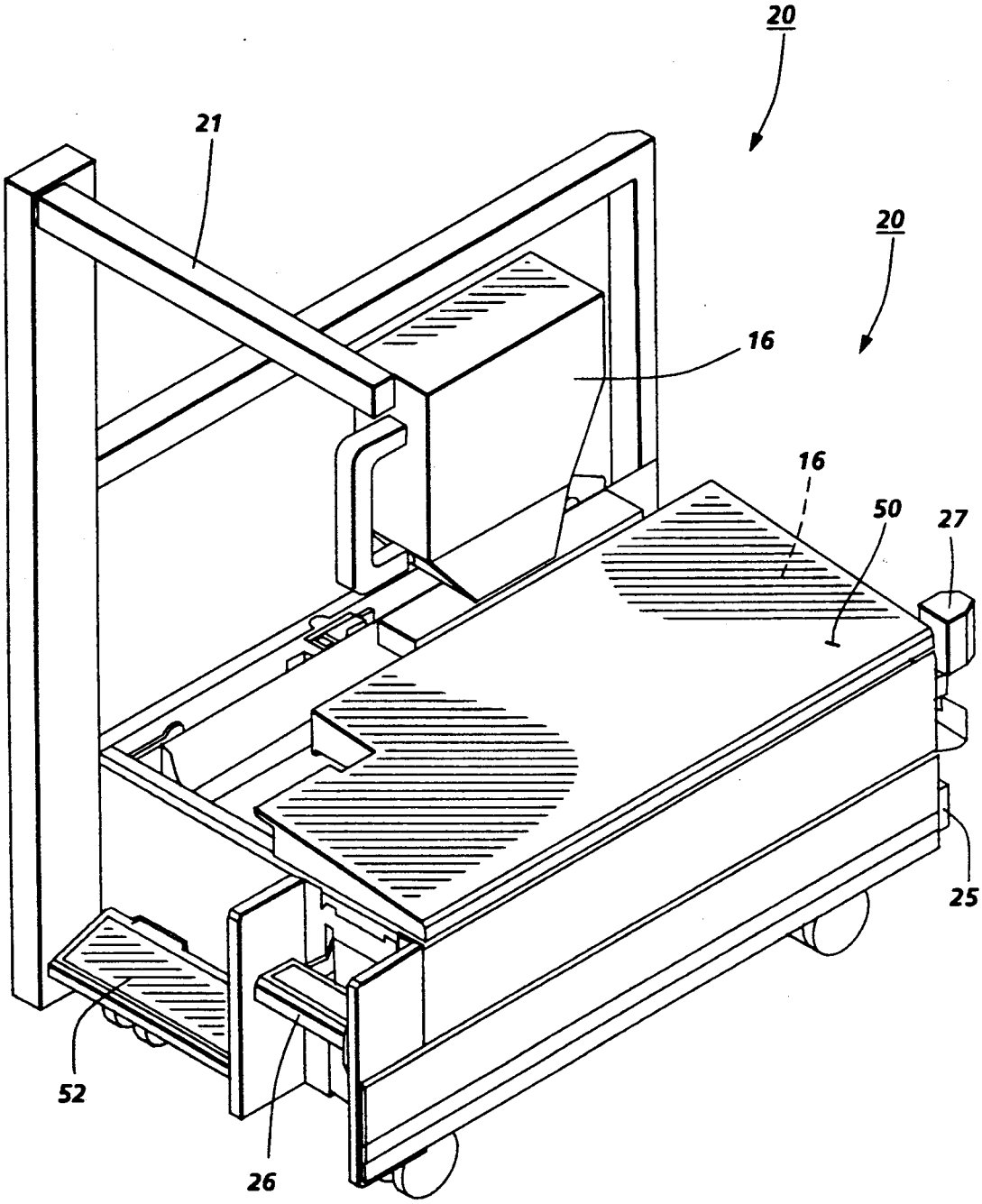
FIG. 9 is a isometric rear angle view of the developer transport cart of FIGS. 3–7.

The pedal cam lock 34 may be of various known mechanical latch types which hold a pedal down until it is pressed again to release it to go back up. In this example, shown enlarged in FIG. 8, cam lock 34 is of the type wherein a pin 35 rides in, and is controlled by, a triangular cam track 36 and is spring biased in one direction (to the right in FIGS. 3–8) and wherein the triangular cam track 36 has a one-way gate provided by a flexible leaf spring 37. The pin 35 movement is shown in FIG. 8 by the dashed line and its arrows. Stepping on the pedal 26 a first time moves the pin 35 down over the top of leaf spring 37 so that the leaf spring 37 deflects the pin 35 around the left side of the triangular cam track 36, to the bottom of cam track 36, where spring bias moves the pin 35 to the right until it is deflected by deflector 36*a* into a stop surface or detent 36*b* in the lower path of cam track 36. The pin 35 stays there in detent 36*b* after the pedal is first released, holding the pedal down (the illustrated phantom position of pin 35 there), until stepping on the pedal a second time moves down and frees the pin 35 from detent 36*b* and allows the pin 35 to move further to the right, so that the release of the pedal 26 a second time allows the pin 35 to ride back up the right side of the triangular cam track 36 and force its way up through the leaf spring 37 gate. That allows the developer rail unit 32 and any developer unit thereon to be lowered (if not otherwise safety locked, as noted). The pin 35 here is controlled by the foot pedal 26 by the pin 26 being mounted on the lower end of a swinging arm or link 38. The opposite (upper) end of this arm or link 38 is pivotally connected at 39 to the main pivoted link 28 which is pivoted by the foot pedal 26. Thus, the pin 35 vertical movement is controlled by the foot pedal 26, but the pin 35 can move horizontally under control of its spring bias, here spring 38*a*, to follow the triangular cam track 36. The abovedescribed safety interlock system 40 can be a simple cable actuated cam or pin preventing the horizontal movement of the swinging arm or link 38 by blocking its path and therefore preventing horizontal movement of the pin 35 and therefore prevent the cart from undocking and the developer unit from lowering. This is merely one example of a suitable pedal cam lock 34.

Once the developer unit 16 is lowered in the cart 20, a tang or projection in the front of the cart extending up from the main frame base of the cart can be provided to engage the developer unit and prevent it from sliding out of the cart in that lowered position (only), or vice versa (a projection from the bottom of the developer unit engaging the cart frame).

The cart 20 also functions as a device for the convenient servicing, storage, protection from physical damage to, and/or protection from dirt contamination of or from, the developer unit. The sides walls of the cart enclose and protect the sides of the developer unit. Likewise the illustrated horizontal bar or arm of the cart handle. A pivotal cover 50 can be provided on the cart 20 to close over the top of the developer unit. To this end the cart may be provided with brakes on the wheels. Also, means may be provided to help the operator move the cart up and over thick electric cables or other obstacles to movement of the cart wheels on the floor, such as the step area 52 on the back of the cart near pedal 26. By the operation stepping on the step area 52 and pulling back on the cart handle the front of the cart 20 can be lifted or assisted over such floor obstacles.

An additional interlock may be provided in the machine 10 to prevent the operator from pulling the developer unit out of the machine and onto the floor if there is no cart present. For example, a projecting pin or tang on the front of the cart can extend into the machine 10 to release an interlock inside the machine which is otherwise preventing the developer unit from rolling out on its rails 18, such as a pivotal tab or stop normally projecting into the movement path of the developer unit on its rails 18 unless and until it is moved out of the way by said pin or tang on the front of the cart.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a system for exchanging a developer unit of a copying or printing machine, in which the developer unit is moved between an independent floor movable developer unit transporter and a development station in said machine while said movable developer unit transporter is docked in alignment with said machine, the improvement wherein:

said floor movable developer unit transporter has liftable development unit holding means adopted to hold and lift a said developer unit thereon;

and said floor movable developer unit transporter includes means for automatically lifting said development unit holding means up to the same level as said development station in said machine, so that a said developer unit thereon is in alignment with said development station in said machine for exchanging a said developer unit, irrespective of variations in the level of said developer unit transporter and said machine due to respective floor level variations;

wherein said means for automatically lifting said development unit holding means up to the same level as said development station in said machine comprises operator foot pedal actuated lever means movable to automatically lift said development unit holding means up to the same level as said development station irrespective of said variations in the level of said developer unit transporter and said machine;

further including docking means for assisting the vertical and lateral alignment of said developer unit transporter with said machine for said docking;

and further including latching means for latching said development unit holding means in said aligned position with said development station of said machine until said latching means is released.

2. The developer unit exchanging system of claim 1, wherein said liftable development unit holding means includes developer unit movement rails adapted to fully align with developer unit movement rails in said development station in said machine for direct movement of a said developer unit therebetween when said means for automatically lifting said development unit holding means up to the same level as said development station in said machine is actuated.

3. The developer unit exchanging system of claim 1, wherein said means for automatically lifting said development unit holding means up to the same level as said development station in said machine also includes docking hook means on said liftable development unit holding means, and a docking bar on said machine which is normally at a higher level than said docking hook means so that said docking hook means is movable thereunder with movement of said developer unit transporter, and wherein said operator foot pedal actuated lever means first lifts said hook means into engagement with said docking bar and then pivots said hook means about said docking bar to lift said development unit holding means into alignment with said development station in said machine.

4. The developer unit exchanging system of claim 1, wherein said movable developer unit transporter is adapted for rapidly exchanging a developer unit preloaded with developer material of one color with a developer unit preloaded with developer material of a different color previously loaded in said development station in said machine.

5. The developer unit exchanging system of claim 1, wherein said means for assisting the lateral alignment of said developer unit transporter with said machine for said docking comprises flexible lateral alignment guide members projecting from the front of said developer unit transporter and fixed vertical lateral alignment guide surfaces on said machine adapted to engage said lateral alignment guide members on said developer unit transporter to laterally guide its final lateral docking movement.

6. The developer unit exchanging system of claim 1, wherein said means for assisting the lateral alignment of said developer unit transporter with said machine for said docking comprises lateral alignment guide members projecting from the lower front of said developer unit transporter and fixed vertical lateral alignment guide surfaces on the lower front of said machine adapted to engage said lateral alignment guide members on said developer unit transporter to laterally guide its final lateral docking movement; and a visual docking guide on the upper front of said developer unit transporter and a visual docking guide target on the front of said machine above said lateral alignment guide surfaces positioned so that when said developer unit transporter is moved so that said visual docking guide is adjacent said visual docking guide target said lateral alignment guide members engage said lateral alignment guide surfaces.

7. The developer unit exchanging system of claim 1, further including safety interlock means for preventing lowering of said development unit holding means or undocking of said developer unit transporter from said machine when a developer unit is in transition between said developer unit transporter and said machine.

8. The developer unit exchanging system of claim 1, wherein said liftable development unit holding means includes developer unit movement rails adapted to fully align with developer unit movement rails in said development station in said machine for direct movement of a said developer unit therebetween when said means for automatically lifting said development unit holding means up to the same level as said development station in said machine is actuated, and wherein said means for automatically lifting said development unit holding means up to the same level as said development station in said machine also includes docking hook means on said liftable development unit holding means, and a docking bar on said machine which is normally at a higher level than said docking hook means so that said docking hook means is movable thereunder with movement of said developer unit transporter, and wherein said operator foot pedal actuated lever means comprises means for first lifting said hook means to engagement with said docking bar and then pivoting said hook means about said docking bar to lift said development unit holding means into alignment with said development station in said machine.

9. The developer unit exchanging system of claim 1, wherein said latching means is connected to and actuated by and released by said same foot pedal which is actuated to lift said development unit holding means up to the same level as said development station.

* * * * *